US008484924B2

(12) United States Patent
Braun

(10) Patent No.: US 8,484,924 B2
(45) Date of Patent: Jul. 16, 2013

(54) PANEL, IN PARTICULAR FLOOR PANEL

(75) Inventor: Roger Braun, Willisau (CH)

(73) Assignee: Flooring Technologies Ltd., Pieta (MT)

( * ) Notice: Subject to any disclaimer, the term of this patent is extended or adjusted under 35 U.S.C. 154(b) by 76 days.

(21) Appl. No.: 12/933,823

(22) PCT Filed: Dec. 29, 2009

(86) PCT No.: PCT/EP2009/009300
§ 371 (c)(1),
(2), (4) Date: Jan. 26, 2011

(87) PCT Pub. No.: WO2010/081532
PCT Pub. Date: Jul. 22, 2010

(65) Prior Publication Data

US 2011/0258959 A1 Oct. 27, 2011

(30) Foreign Application Priority Data

Jan. 16, 2009 (EP) ..... 09000540

(51) Int. Cl.
*E04F 13/08* (2006.01)
*E04B 2/00* (2006.01)

(52) U.S. Cl.
USPC ..... 52/588.1; 52/589.1; 52/592.1; 52/392

(58) Field of Classification Search
USPC ..... 52/578, 588.1, 589.1–591.4, 592.1, 52/390, 392
See application file for complete search history.

(56) References Cited

U.S. PATENT DOCUMENTS 2,740,167 A * 4/1956 Rowley ..... 52/591.1
3,921,312 A * 11/1975 Fuller ..... 434/96

(Continued)

FOREIGN PATENT DOCUMENTS

DE 19929896 1/2001
DE 10057901 6/2002

(Continued)

OTHER PUBLICATIONS

International Preliminary Report on Patentability for Application No. PCT/EP2009/009300, issued Jul. 19, 2011.

(Continued)

*Primary Examiner* — Joshua J Michener
*Assistant Examiner* — Elizabeth A Plummer
(74) *Attorney, Agent, or Firm* — Andrew M. Calderon; Roberts Mlotkowski Safran & Cole, P.C.

(57) ABSTRACT

A panel, in particular a floor panel, with a core consists of a wood material or a wood material-plastic mixture. A top side and a bottom side are provided. The panel has on a first lateral edge a lower locking element, which includes a first arm that is arranged on the bottom side of the panel and that projects over the first lateral edge. A first hook element with an undercut is arranged on an outer end of the first arm. The panel has on a second lateral edge that is opposite to the first lateral edge an upper locking element with a second arm that is arranged on the top side of the panel and that projects over the second lateral edge. A second hook element, which has at least one locking nose, is arranged on an outer end of the second arm, such that two identically designed panels can be connected and locked to one another in the horizontal direction and in the vertical direction after the locking nose of one panel is snapped into the undercut of a second panel. In the first arm of the lower locking element, at least one integral slot is provided with a width that is smaller than that of the second hook element.

17 Claims, 6 Drawing Sheets

U.S. PATENT DOCUMENTS

| | | | | |
|---|---|---|---|---|
| 6,862,857 | B2 * | 3/2005 | Tychsen | 52/582.1 |
| 7,506,481 | B2 * | 3/2009 | Grafenauer | 52/592.1 |
| 7,603,826 | B1 * | 10/2009 | Moebus | 52/592.1 |
| 8,099,924 | B2 * | 1/2012 | Braun | 52/588.1 |
| 2003/0009971 | A1 * | 1/2003 | Palmberg | 52/578 |
| 2007/0130872 | A1 * | 6/2007 | Goodwin et al. | 52/592.1 |
| 2008/0241440 | A1 * | 10/2008 | Bauer | 428/33 |
| 2009/0193748 | A1 * | 8/2009 | Boo et al. | 52/589.1 |
| 2010/0218450 | A1 * | 9/2010 | Braun et al. | 52/588.1 |
| 2011/0094178 | A1 * | 4/2011 | Braun | 52/588.1 |
| 2012/0067461 | A1 * | 3/2012 | Braun | 144/371 |

FOREIGN PATENT DOCUMENTS

| | | | |
|---|---|---|---|
| DE | 20203311 | | 6/2002 |
| DE | 10305695 | | 9/2004 |
| DE | 102007020271 | | 8/2008 |
| DE | 102007020271 | A1 * | 8/2008 |
| DE | 102007015048 | | 10/2008 |
| FR | 2498666 | A * | 7/1982 |
| WO | WO 0188306 | A1 * | 11/2001 |
| WO | 2008133377 | | 11/2008 |

OTHER PUBLICATIONS

Written Opinion of the International Searching Authority for Application No. PCT/EP2009/009300, issued Jul. 19, 2011.

* cited by examiner

PANEL, IN PARTICULAR FLOOR PANEL

BACKGROUND OF THE INVENTION

1. Field of the Invention

The invention relates to a panel, in particular a floor panel, with a core that consists of a wood material or a wood material-plastic mixture, a top side and a bottom side, which panel has on a first lateral edge a lower locking element, which comprises a first arm that is arranged on the bottom side of the panel and that extends from the first lateral edge, and a first hook element with an undercut that is arranged on an outer end of the first arm, and which panel has on a second lateral edge that is opposite to the first lateral edge an upper locking element with a second arm that is arranged on the top side of the panel and that extends from the second lateral edge, and a second hook element, which has at least one locking nose, arranged on an outer end of the second arm, such that two identically designed panels can be connected and locked to one another in the horizontal direction and in the vertical direction after the locking nose of one panel is snapped into the undercut of a second panel.

2. Discussion of Background Information

Such a panel is known, for example, from DE 199 29 896 A1. Two of the panels described there are connected to one another by a joining motion that runs perpendicular to the placement plane. In this case, both the lower locking element and the upper locking element are widened continuously in an elastic manner until the locking nose of one panel snaps into the undercut of the second panel. Two thus connected panels are connected and locked to one another both in the horizontal direction and in the vertical direction.

The strength of the lock, i.e., the force that has to be applied to separate once again two panels that are connected and locked to one another, is in this case, i.a., determined in how far the locking nose of one panel can snap into the undercut of the second panel. The further the locking nose engages in the undercut, the stronger the lock in the panels is. To achieve as strong a locking as possible, the locking elements are to be widened as far as possible in an elastic manner. To this end, the material, of which the two locking elements consist, has to have a relatively high elasticity.

DE 103 05 695 A1 also discloses floor panels that can be connected to one another by a joining motion that runs perpendicular to the placement plane. The panels have an essentially mushroom-shaped locking strip on a lateral edge and an essentially mushroom-shaped locking groove in cross-section on a lateral edge opposite to this lateral edge. When two panels are joined together, the essentially mushroom-shaped locking strip is now inserted into the locking groove. In this case, the locking groove has to be widened elastically by the mushroom shape until the mushroom-shaped locking strip snaps in.

Also, in this case, the locking groove has to be widened as far as possible in an elastic manner as far as possible to achieve a strong locking of the two panels relative to one another.

Also, DE 202 03 311 U1 discloses floor panels that can be locked to one another by a vertical joining motion. Also, in the solution shown there, a locking nose of one panel snaps into an undercut of the other panel. Also, in this case, the locking element of one panel has to be widened to ensure locking.

As core material for the panels, in particular medium-density fiber plates (MDF) or high-density fiber plates (HDF) are suitable. The latter have great strength, so that they can readily withstand the stresses to which floor panels in particular are exposed from walking. It is disadvantageous that these vehicles are elastically deformable only to a slight extent. As a result, the locking elements can be widened elastically only within a limited extent. Thus, the possible strength of the locking of two panels is also limited by the selection of the core material.

DE 10 2007 015 048 A1 discloses panels in which a spring element, which can snap into a groove provided for this purpose on the opposite side of another panel, is formed on at least one lateral edge. The spring element extends along the lateral edge and is connected to the core of the panel only at its two ends. In between, it is released by two grinding processes and can accordingly be deflected horizontally. When the two panels are connected, the spring element is deflected and snaps into the groove that is provided for this purpose in the second panel when the two panels have reached the previously defined end position. As a result, both panels are connected and locked to one another at least in the vertical direction.

The strength of the locking is determined in this case by the thickness of the spring element. In particular in the case of thin panels, the spring element must also be designed very thin, so that in particular in these cases, it can result in a locking that is not designed to be strong enough.

DE 10 2007 020 271 A1 discloses floor panels, on whose lateral edges locking elements for vertical locking are provided. In this case, a locking projection of a panel emerges through a window on the other panel and engages the peripheral wall of this window. By the design of this window, a bending beam clamped on two sides is formed, and said beam is deflected for locking and snapped back again into the locking position.

It is disadvantageous that this bending beam, which extends along a lateral edge of a panel, is connected to the panel only at its two ends. In this respect, in particular in floor panels that are laid on an uneven base, the heavy loads that arise from walking can cause the connection between the bending beam and the panel core to break. In this case, the two panels are no longer locked to one another.

Moreover, because the locking element penetrates the window, it can happen that the bending beam can have only about one-third of the panel thickness count as thickness. In particular in the case of thin panels, the stability of the locking is thus greatly reduced such that this solution can be applied only for thick panels.

SUMMARY OF THE INVENTION

The object of the invention is therefore to improve the above-described panels in such a way that even in the case of thin panels, a strong and secure locking of two identical panels to one another is possible both in the vertical direction and in the horizontal direction.

The invention achieves this object by a generic panel in which in the arm of the lower connecting element, at least one integral slot is provided with a width that is smaller than that of the second hook element.

This at least one slot releases a part of the first hook element relative to the core in the horizontal direction. As a result, the first hook element can be deflected more simply and further both primarily in the horizontal direction and secondarily around an axis that is parallel to the lateral edge of the panel. As a result, a further widening of the lower locking element is possible in such a way that the locking nose of the second hook element can engage again in the undercut of the lower locking element, by which the locking of both panels to one another is strengthened.

Advantageously, the at least one slot runs parallel to the first lateral edge. As a result, it is ensured that the production of such a panel is simple and quickly possible. Because of the position and the length of the at least one slot, it is possible to set very precisely how far the lower locking element can be widened during the connecting and locking of the two panels with one another.

Advantageously, multiple slots are provided. As a result, it is ensured that the arm of the lower locking element is not interrupted at specially stressed points, for example in the middle of the lateral edge of the panel, and thus has a higher stability.

The multiple slots are preferably arranged at various distances from the first lateral edge. Advantageously, at least two slots run at least partially beside one another. In this way, it is ensured that the arm over the entire length of the lateral edge is interrupted by at least one slot without weakening the stability of the lower locking element too greatly.

At least one of the slots is advantageously arranged at one end of the first lateral edge. As a result, the elasticity of the lower locking element is increased primarily in the edge area.

Advantageously, at least one locking nose on the second hook element is designed shorter than the second lateral edge.

The second hook element preferably has multiple locking noses that are arranged beside one another. The positions of the at least one slot and the at least one locking nose along the lateral edge preferably correspond to one another. In this way, it is ensured that at the points at which a locking nose is located on the second hook element, a slot in the arm is provided on the lower locking element. As a result, the elasticity of the arm is increased at specifically these points, and a deflection or widening of the lower locking element is facilitated. At the points at which no locking nose is provided, in this case there is also no slot in the arm of the lower locking element, so that the latter has full stability there. In particular, when at least one of the slots is located on one end of the first lateral edge, locking noses should also be provided at the end of the second lateral edge. The latter can be even longer than the at least one slot at the end of the lateral edge with use of the rotating deflection motion.

The return force of the lower locking element is mainly determined by the position and the length of the at least one slot. The length of at least one locking nose at the second hook element is also variable. It has a significant influence on the motion that embodies the lower locking element. If the locking nose is shorter than the corresponding slot, the first hook element is moved mainly horizontally. If the length of the locking nose, however, is only slightly shorter than each of the at least one corresponding slot, the first hook element is more strongly forced into a rotating deflection motion.

Advantageously, the bottom side of the first arm runs at an angle $\alpha$ relative to the horizontal upward. This reduction of the bottom side of the plate provides for elevated elasticity of the lower locking element. As a result, it is possible to widen the lower locking element still further without influencing the stability of the arm.

The angle $\alpha$ advantageously is between 0 and approximately 15°.

When the first lateral edge above the first arm has an undercut, the free length of the first arm is extended. As a result, the lower locking element can be further widened when two identical panels are to be connected and locked to one another.

The undercut can be designed as, for example, a groove, in particular a groove that is rectangular in cross-section, in the first lateral edge above the first arm.

The first lateral edge and the second lateral edge of a panel according to the invention can in each case have a horizontal joining edge. By these joining edges, a recess is formed on a lateral edge, and a corresponding projection is formed on the opposite lateral edge of the panel. When two panels are laid and joined together, in this case the projection is inserted into the recess. As a result, the vertical positioning of the panels during the laying is decoupled from the actual locking mechanism.

BRIEF DESCRIPTION OF THE DRAWINGS

Using a drawing, embodiments of the invention are described in more detail below. The drawings show.

DETAILED DESCRIPTION OF THE PRESENT INVENTION

Figure 1A:
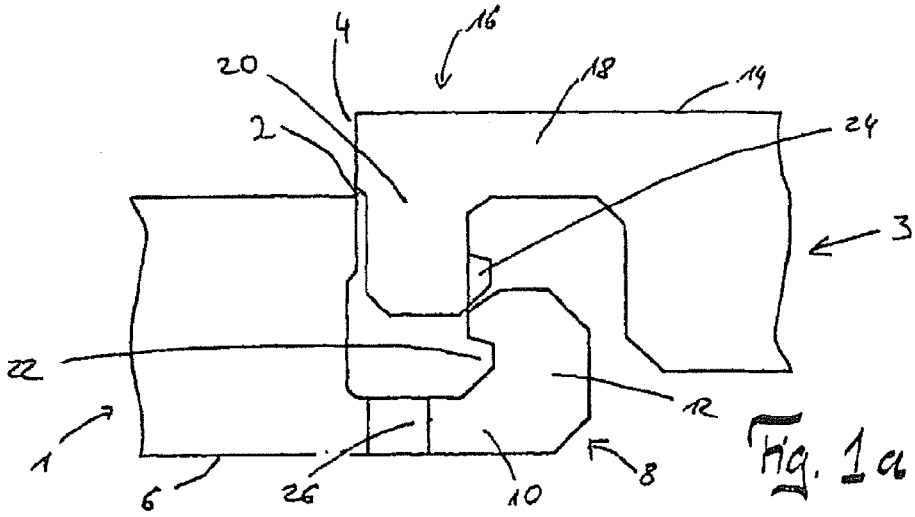
FIGS. 1*a* to 1*c*—show a cutaway of two panels according to a first embodiment of this invention in various stages of the locking process, FIG. 2—shows a diagrammatic top view of a panel according to a second embodiment of this invention, FIG. 3—shows a section along the line III-III of FIG. 2, FIG. 4—shows a cutaway of two panels according to a third embodiment of this invention, FIG. 5—shows a cutaway of two panels according to a fourth embodiment of this invention, FIG. 6—shows a cutaway of two panels according to a fifth embodiment of this invention, and FIG. 7—shows another embodiment in a representation according to FIG. 4.
Figure 1B:
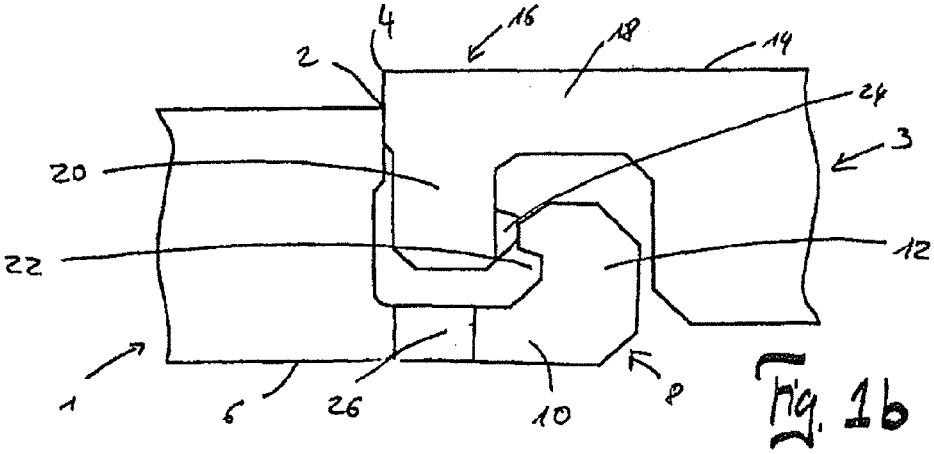
Figure 1C:
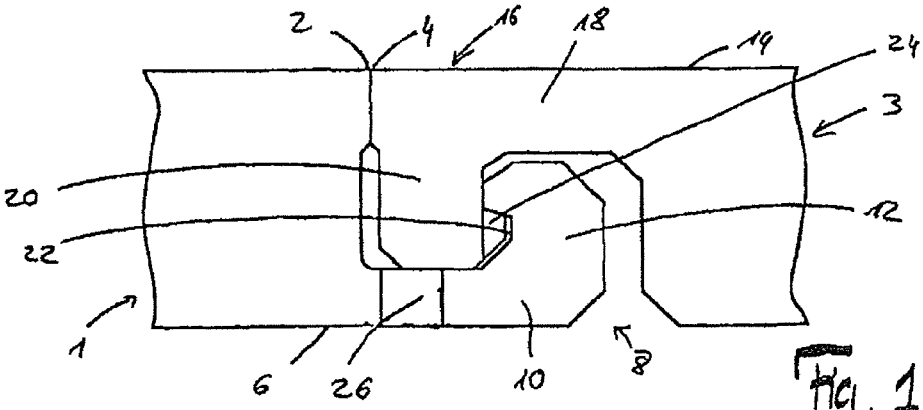

FIGS. 1*a* to 1*c* show various stages of the connecting process of two identical panels. In this case, a first lateral edge 2 of a first panel 1 and a second lateral edge 4 of a second panel 3 are shown. On a bottom side 6 of the first panel 1, a lower locking element 8 is arranged. The lower locking element 8 has a first arm 10 that extends from the first lateral edge 2, on whose arm's one outer end a first hook element 12 is arranged and which has a slot 26.

On a top side 14, the panel 3 has an upper locking element 16. The upper locking element 16 comprises a second arm 18 that extends from the second lateral edge 4, and on whose arm's other end a second hook element 20 is arranged.

The first hook element 12 of the lower locking element 8 has an undercut 22. Corresponding to this, the second hook element 20 has a locking nose 24.

Figure 2:
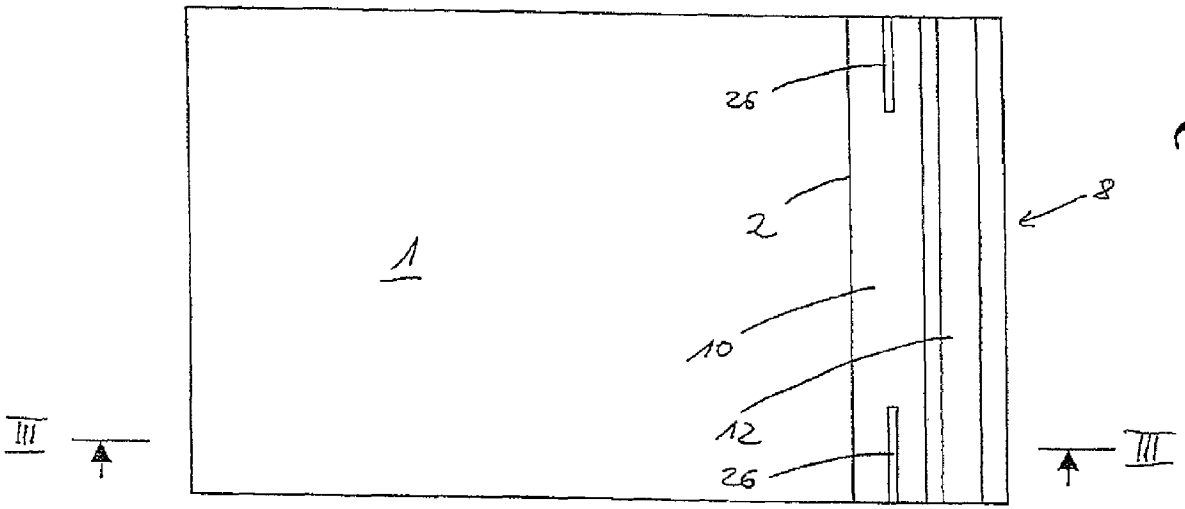
Figure 5:
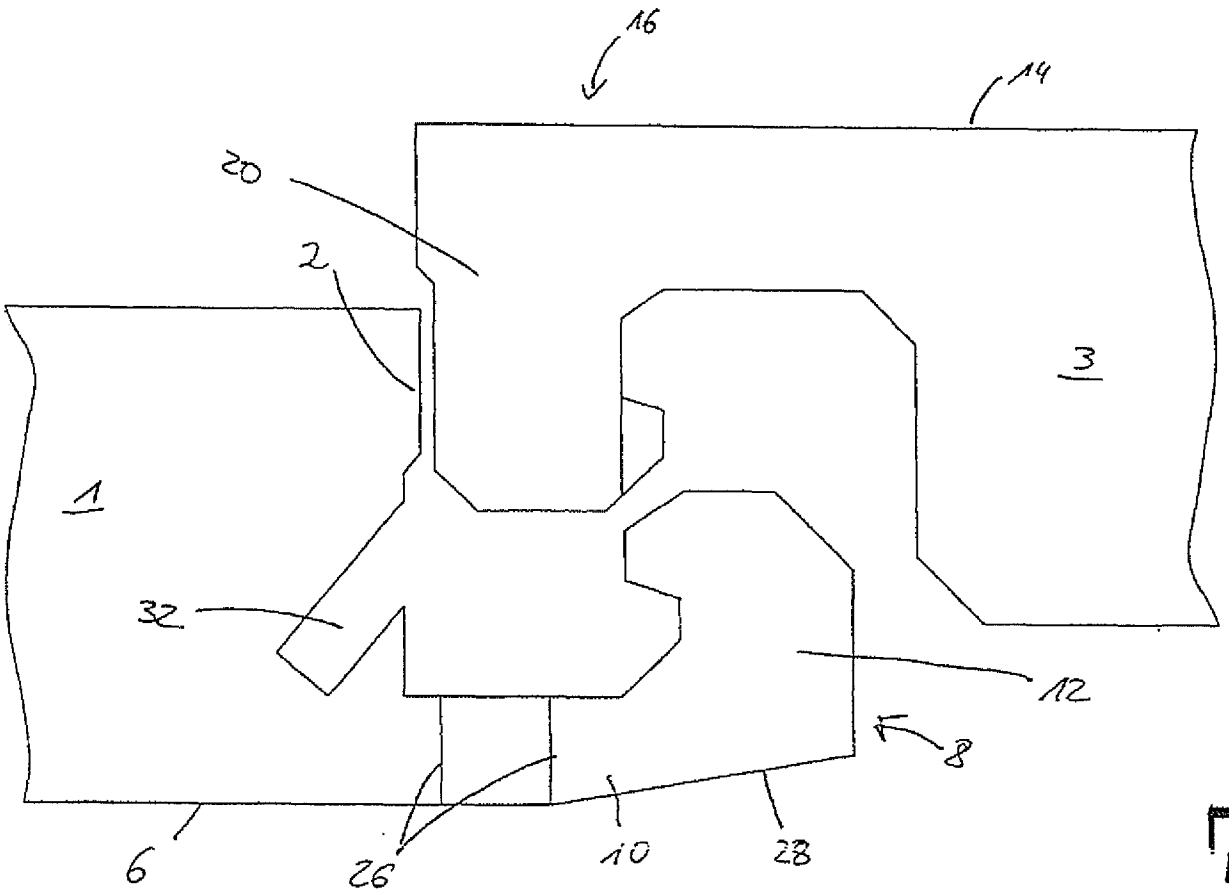
Figure 6:
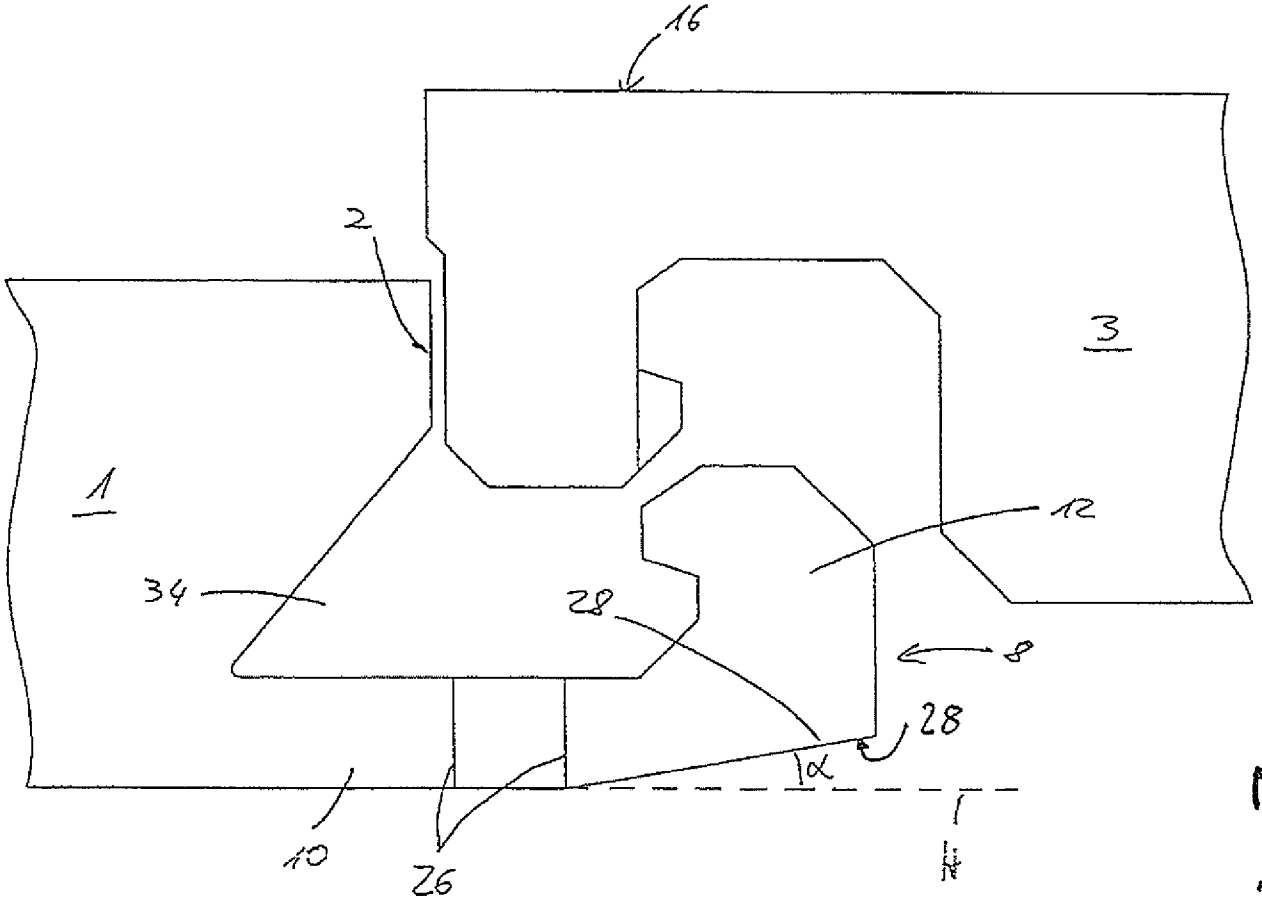

In the embodiment shown in FIG. 2, two slots 26 have been introduced into the first arm 10 of the lower locking element 8. In the arm 10, multiple slots 26 can also be arranged parallel to one another, as is indicated in FIGS. 5 and 6. Preferably, however, in each case only one integral slot 26 is provided.

In FIG. 1*a*, the two panels 1 and 3 are shown before the locking. They are arranged relative to one another in such a way that the locking can be done by a vertical joining motion of the second panel 3 relative to the first panel 1.

FIG. 1*b* shows the two panels 1, 3 during the locking process. In comparison to FIG. 1*a*, the second panel 3 is lowered relative to the first panel 1. In this case, the second hook element 20 provides for the lower locking element 8 to be widened. In this case, the first hook element 12 can embody both a horizontal movement toward the left as well as a rotation around an axis that is perpendicular to the drawing plane. This is made possible by the slot 26 provided in the first arm 10 of the lower locking element 8.

In FIG. 1*c*, the two panels 1, 3 are locked with one another. In this case, the locking nose 24 of the second hook element 20 is snapped into the first hook element 12 in the undercut 22. Here, the first hook element 12 again springs back into its starting position.

The first hook element 12 extends over the entire length of the first lateral edge 2. It can, for example, be produced simply by a stationary tool according to the principle of the stationary blade, whereby the motion of the workpiece is used for machining. The lower locking element 8 itself is manufactured by, for example, one or more permanent, rotating milling tools. The slots 26 can also be made simply by a likewise rotating milling tool, which moves into and out of the panel material by a swiveling movement during the transport of the panel. As an alternative, other methods such as lasers or punches can also be used. The production can be carried out in a continuous or clocked process.

In the embodiment shown, the locking nose 24 of the second hook element 20 does not extend over the entire length of the second lateral edge 4. Its length corresponds to the position of the slot 26 in the first arm 10. It is thus ensured that the elasticity of the lower locking element 8 is increased precisely at the location where a deflection of the first hook element 12 is necessary for locking the two panels 1, 3. At the locations at which no locking nose 24 is provided, the lower locking element 8 has full stability. The locking nose 24 is formed by, for example, a stationary tool. The number of locking noses 24 corresponds to the number of slots 26 (cf. FIG. 2).

For locking and connecting the two panels, the second hook element 20 is guided behind the first hook element 12 on the first panel 1 by a rocking of the second panel 3. Here, the locking nose 24 deflects the first hook element 12 until it has passed the latter. This is enabled or simplified by the slot 26 provided in the first arm 10. Then, the first hook element 12 is moved back into its starting position, by which the two panels 1, 3 are both locked in horizontal and in vertical direction. If multiple locking noses 24 are provided, a locking nose 24 for locking nose 24 is locked when the second panel 3 is rocked so that a connection is produced depending on the type of slide fastener.

FIG. 2 shows a diagrammatic top view of a first panel 1. A lower locking element 8 is molded onto the first lateral edge 2. This lower locking element 8 again has a first arm 10 and a first hook element 12. In the embodiment that is shown, two slots 26 that are arranged on the respective ends of the first lateral edge 2 are provided in the first arm 10. As a result, the elasticity of the lower locking element 8 is increased especially in the edge area. Preferably, two locking noses that also are arranged in the outer edge areas of the lateral edge and that are matched in this respect to the opposite lateral edge, not shown, are provided.

Figure 3:
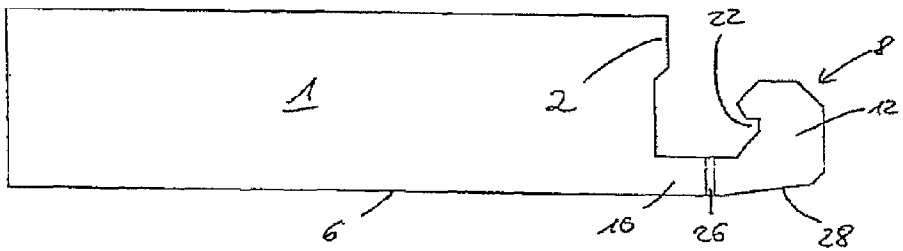

FIG. 3 shows a section along the line III-III according to FIG. 2.

The lower locking element 8 is arranged on the bottom side 6 of the first panel 1. A slot 26 is provided in the first arm 10 of the lower locking element 8.

In this case, the bottom side 28 of the first arm 10 runs at an angle $\alpha$ relative to the horizontal upward. As a result, the elasticity of the lower locking element 8 is increased again, without the stability of the first arm 10 being further impaired. In this way, the first hook element 12 can be further deflected when two identical panels are joined together. The angle $\alpha$ is preferably between 0 and approximately 15°.

Figure 4:
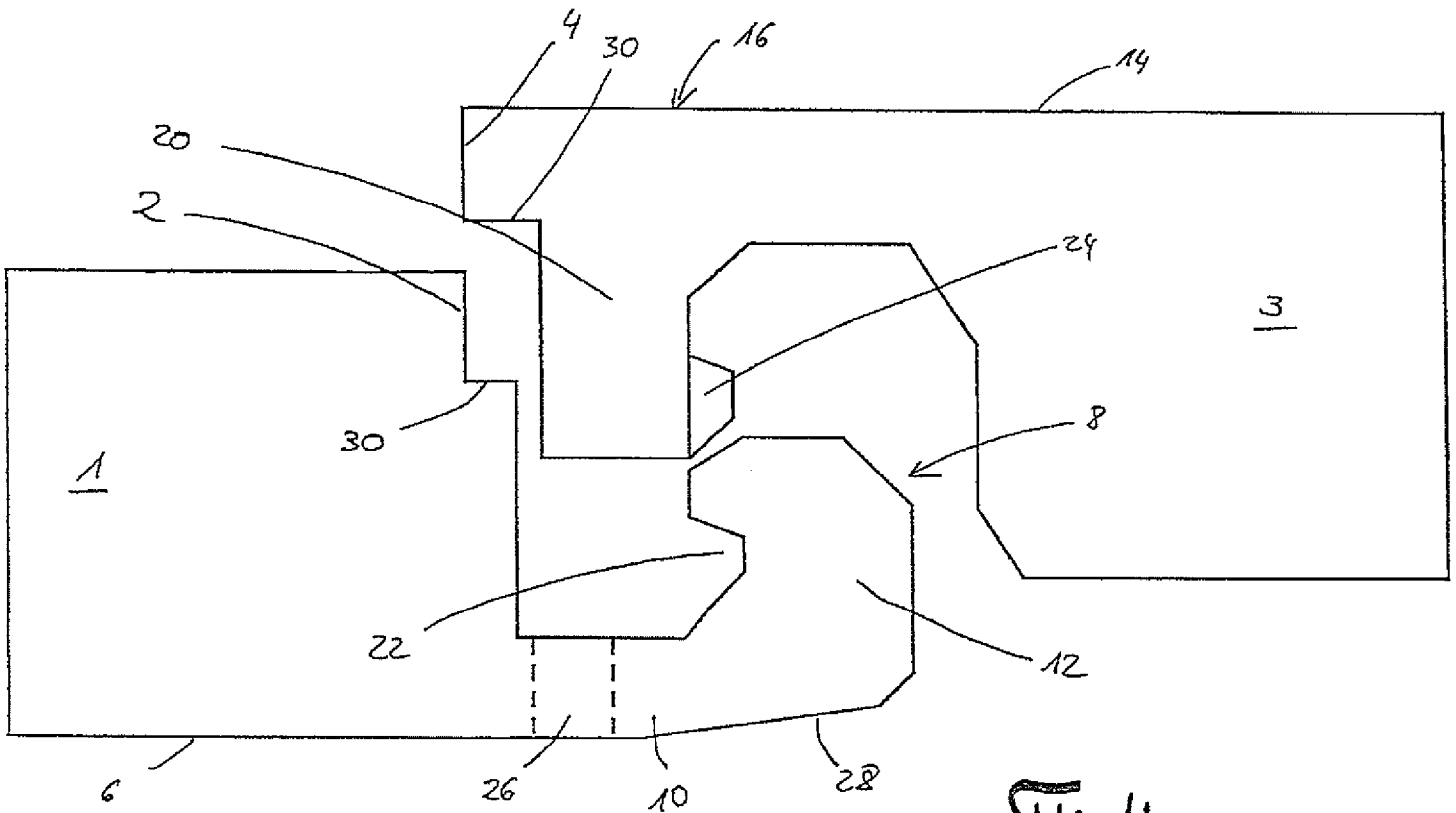

FIG. 4 shows a cutaway of two panels 1, 3 before they are joined together. As in FIG. 3, the lower locking element 8, whose first arm 10 has a bottom side 28 that runs upward relative to the horizontal H at an angle $\alpha$ that is not indicated, is arranged on the bottom side 6 of the first panel 1. When the panels 1, 3 are joined together, the first hook element 12 is again deflected until the locking nose 24 on the second hook element 20 engages in the undercut 22 on the first hook element 12 that is provided for this purpose. The panel 1 has a horizontal joining edge 30 on its first lateral edge 2. A horizontal joining edge 30 is also provided on the second lateral edge 4 of the second panel 3. In this case, the two horizontal joining edges 30 are designed in such a way that they rest on one another in the connected and locked state of panels 1, 3. The projection formed by the horizontal joining edge 30 and located on the panel 3 coming from above is inserted here into the recess that is formed by the horizontal joining edge 30 on the first panel 1. As a result, it is ensured that the positioning of the panels 1, 3 is decoupled from the actual locking mechanism.

FIG. 5 shows a cutaway of two panels 1, 3 according to a fourth embodiment of this invention. As in the above-described embodiments, the lower locking element 8 is arranged on the bottom side 6 of the first panel 1. Two slots 26 are arranged in the first arm 10, whose bottom side 28 again runs upward in an angle $\alpha$ relative to the horizontal H. For locking, the second hook element 20 of the upper locking element 16, which is arranged on the top side 14 of the second panel 3, engages in the first hook element 12. On its first lateral edge 2, the first panel 1 has a rectangular groove 32, through which the freedom of motion of the lower locking element 8 and thus the first hook element 12 is further increased. In this way, it is achieved that when the two panels 1, 3 are locked, the first hook element 12 can be further deflected without the stability of the first arm 10 being impaired. In FIG. 6, the same effect is caused by an undercut 34 that is provided in the first lateral edge 2 of the first panel 1. In this way, the free length of the first arm 10 is extended in such a way that when the two panels 1, 3 are locked, the first hook element 12 can be further deflected without impairing the stability of the first arm 10.

Also, in FIG. 6, the bottom side 28 of the first arm 10 runs upward at an angle $\alpha$ relative to the horizontal H.

Figure 7:
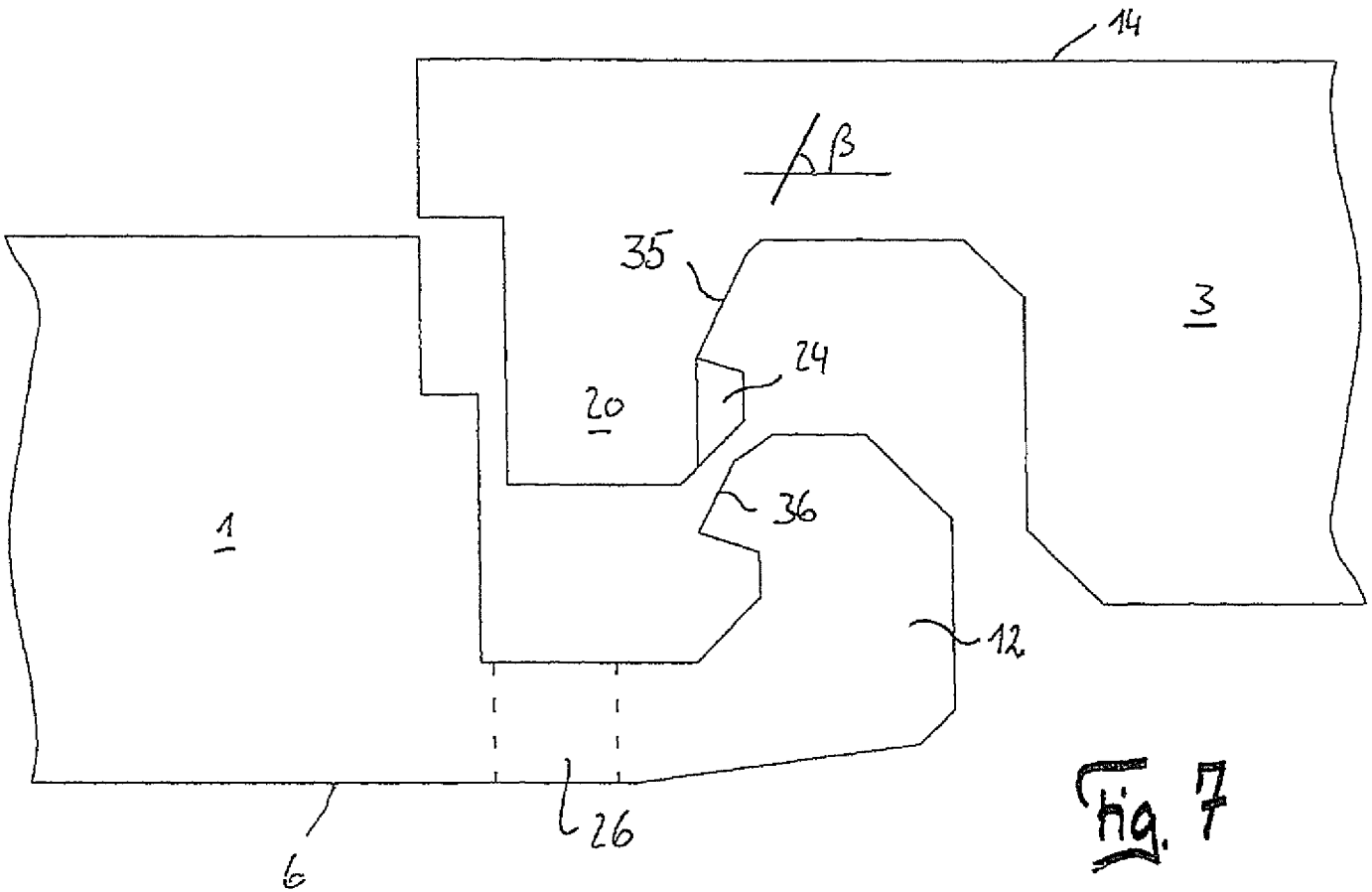

In the embodiment that is shown in FIG. 7, the contact surfaces 35, 36 of the first and second hook elements 12, 20 run at an angle $\beta$ that is inclined relative to the horizontal. In such a configuration, the locking process proceeds with little effort.

The invention claimed is:

1. A panel comprising a core of a wood material or a wood material-plastic mixture, the panel further comprising:

a top side and a bottom side;

a first lateral edge comprising a lower locking element, which comprises a first arm that is arranged on the bottom side and that extends from the first lateral edge, and a first hook element with an undercut that is arranged on an outer end of the first arm; and a second lateral edge that is opposite to the first lateral edge, comprising an upper locking element with a second arm that is arranged on the top side and that extends from the second lateral edge, and a second hook element, which has at least one locking nose, arranged on an outer end of the second arm, wherein, in the first arm of the lower locking element, at least one integral slot is provided with a width that is smaller than that of the second hook element, and the length of the at least one integral slot runs parallel to the first lateral edge and the at least one integral slot is a through hole.

2. The panel according to claim 1, wherein the at least one integral slot is multiple slots.

3. The panel according to claim 2, wherein the multiple slots are arranged at varying distances from the first lateral edge.

4. The panel according to claim 3, wherein at least two slots of the multiple slots run at least partially beside one another.

5. The panel according to claim 1, wherein the at least one integral slot is arranged at one end of the first lateral edge.

6. The panel according to claim 1, wherein the at least one locking nose is shorter than the second lateral edge.

7. The panel according to claim 1, wherein the second hook element has multiple locking noses.

8. The panel according to claim 1, wherein positions of at least one slot of the at least one integral slot and at least one locking nose along the lateral edges correspond to one another.

9. The panel according to claim 1, wherein a bottom side of the first arm runs at an angle $\alpha$ relative to a horizontal upward.

10. The panel according to claim 9, wherein the angle $\alpha$ is between 0 and approximately 15°.

11. The panel according to claim 1, wherein the first lateral edge has an undercut above the first arm.

12. The panel according to claim 11, wherein the undercut in the first lateral edge is a groove above the first arm.

13. The panel according to claim 12, wherein the groove is rectangular in cross-section.

14. The panel according to claim 1, wherein the first lateral edge and the second lateral edge have a horizontal joining edge.

15. The panel according to claim 1, wherein the panel is a flooring panel.

16. The panel according to claim 1, wherein the at least one integral slot liberates part of the first hook element with respect to a core, whereby the first hook element can be deflected both in a horizontal direction and about an axis parallel to the lateral edge.

17. A combination of panels comprising two identically designed panels according to claim 1, wherein the two identically designed panels are connected and locked to one another in a horizontal direction and in a vertical direction after the locking nose of one panel is snapped into the undercut of a second panel.

* * * * *